US005456554A

United States Patent [19]

Barrett et al.

[11] Patent Number: 5,456,554

[45] Date of Patent: Oct. 10, 1995

[54] INDEPENDENTLY ADJUSTABLE FACING PANELS FOR MECHANICALLY STABILIZED EARTH WALL

[75] Inventors: Robert K. Barrett, Grand Junction; George Hearn, Boulder; Henrie Henson, Mt. Littleton; Michael L. McMullen, Denver, all of Colo.

[73] Assignee: Colorado Transportation Institute, Denver, Colo.

[21] Appl. No.: 178,834

[22] Filed: Jan. 7, 1994

[51] Int. Cl.[6] ..... E02D 29/02

[52] U.S. Cl. ..... 405/284; 405/262; 405/286

[58] Field of Search ..... 405/262, 284, 405/285, 286; 52/508, 513, 506.01, 506.05, 698, 717

[56] References Cited

U.S. PATENT DOCUMENTS

| | | | |
|---|---|---|---|
| 1,762,343 | 6/1930 | Munster . | |
| 3,686,873 | 8/1972 | Vidal . | |
| 4,440,527 | 4/1984 | Vidal . | |
| 4,564,316 | 1/1986 | Hunziker . | |
| 4,790,690 | 12/1988 | Vidal et al. . | |
| 4,929,125 | 5/1990 | Hilfiker . | |
| 4,960,349 | 10/1990 | Willibey et al. | 405/262 |
| 4,961,673 | 10/1990 | Pagano et al. . | |
| 5,028,172 | 7/1991 | Wilson et al. . | |
| 5,064,313 | 11/1991 | Risi et al. | 405/284 |

FOREIGN PATENT DOCUMENTS

| | | | |
|---|---|---|---|
| 0176525 | 7/1988 | Japan | 405/262 |

*Primary Examiner*—Randolph A. Reese
*Assistant Examiner*—Frederick L. Lagman
*Attorney, Agent, or Firm*—Gary D. Fields

[57] ABSTRACT

A retaining wall has at least two facing panels in a tier adjacently interconnected by at least a pair of panel interconnectors mounted to the inner surfaces of the panels to allow adjacent panels to rotate relative to each other. Horizontal flexible anchoring devices, which include rigid anchors flexibly or rigidly connected to the panel interconnectors, connect the facing panels to an earth mass. The panels may tilt, or horizontally deform, relative to deformations in the earth mass. Front horizontal panel adjustment devices allow the tension of the connection between the flexible anchoring devices and the panel interconnectors to be varied from the front of the wall to allow horizontal alignment of the panels after the earth wall has been built. An adjustable inner panel supports the facing panels prior to the start of earth wall construction. Geofabric layers, independent of the flexible anchoring, are used during construction to stabilize the earth wall. The method includes erecting a first tier of interconnected panels, back filling the earth mass, flexibly anchoring the panels to the earth mass, completing the earth mass construction, and adjusting the horizontal alignment of the panels from the front of the panels.

18 Claims, 6 Drawing Sheets

INDEPENDENTLY ADJUSTABLE FACING PANELS FOR MECHANICALLY STABILIZED EARTH WALL

TECHNICAL FIELD

This invention relates generally to retaining walls for earth structures, and more particularly, to adjustable articulated independent retaining walls for shifting earth structures.

BACKGROUND OF THE INVENTION

Because of their durability and cost-effectiveness, mechanically stabilized earth structures, or earth masses, have been used routinely for many years in various applications in highway projects such as for walls, embankments, bridge abutments, roadway supports, and others. Often, facing walls are used in conjunction with the earth masses to provide a forming surface during the placement of the fill and reinforcements used to construct the mass. The facing walls retain the earth mass after construction to protect the mass from erosion and to protect fabric reinforcements from UV degradation. The facing walls also often serve the purpose of providing an aesthetically pleasing cover for the earth masses.

Various facing walls and wall assembly methods are presently known and used in the constructions of earth mass (fill) structures. A facing panel system used as a restraining form primarily for cement structures is disclosed in U.S. Pat. No. 4,564,316 to Hunziker. The method and facing panel system include a cantilever support which couples two vertically adjacent panels. Cementitious fill is placed behind the lower panel and allowed to solidify. The lower panel is secured to the solidified cementitious fill by a rigid tie-back anchor to form a monolithic mass. The cantilever support transfers horizontal loads exerted on the upper panel as fill material is placed behind the panel back through to the fill mass via the lower panel. In one embodiment, external strongbacks are used to provide the cantilever support; in another embodiment the cantilever support is internal. Vertical adjustment means are provided in both embodiments. For the internal support, the vertical adjustment takes place from behind the panels and is thereby limited to adjustment during wall construction only. For the external support, the vertical adjustment takes place from the front of the panels during the construction of the wall. However, this means is not part of the facing wall structure itself, and no vertical adjustment of the panels can take place once the wall is completed. Neither shifts in the cementitious fill, nor panels response thereto, is addressed in Hunziker. Because the facing wall is rigidly anchored to the cementitious fill, it becomes a fixed monolithic structure with the solidified fill after construction of the wall.

A retaining wall utilizing a compacted granular fill earth mass and facing front panels is disclosed in U.S. Pat. No. 4,961,673 to Pagano et al. The granular fill earth mass includes a plurality of elongated tensile strips to increase the coherency of the mass. The mass also includes grid-form reinforcements having an L-shaped cross-section. Attachment clips attach the tensile strips to the grid forms. The retaining wall also utilizes facing panels having reinforcing members, tensile member extensions, connecting members, and generally parallel layers of concrete between the front face of the fill mass and the back surface of the panels. The tensile member extensions and connecting members form a mechanical linkage to connect the reinforcing members to the tensile strips. The connecting members also may be adjustable, in a manner similar to a turnbuckle, to adjust for various spacings between the rigid reinforcing members and the tensile strips. Concrete layers are poured over the connections and entirely fill a space between the back of the panels and the front of the earth mass. The Pagano retaining wall focusses on the problem of strains placed upon the facing wall, and the adverse affect to the planar appearance to the wall caused thereby, during post construction compaction of the earth mass. It solves the problem by maintaining the deformability of the structure within the grids and the tensile strips inside the earth fill mass, which are capable of straining in response to consolidation of the earth mass. The deformability is, however, localized solely to within the earth mass itself by the provision of the concrete layers between the facing wall and the fill mass. The facing front panels are, thus, divorced from the strains due to consolidation of the earth mass and remain fixed and rigid by becoming part of the monolithic mass of solidified concrete. While suited for its intended purpose, the Pagano wall requires extra material and steps to construct a facing wall which is not adversely effected by the consolidation of the earth mass.

U.S. Pat. No. 5,028,172 to Wilson, et al., discloses a soil reinforcing structure including a planar wall member and at least one grid member horizontally permanently connected to the wall member. The grid member, either in itself or in connection with another grid, acts as an earth mass reinforcement. The grid member, is resiliently flexible, ie., capable of being rolled up, or restorably folded, against the rear surface of the wall member for ease of storage and transportation. Also provided is a connecting grid which interconnects two anchoring grids. The Wilson structure provides an improved means of connecting anchoring grids wherein the connection is easy to facilitate and is easily adapted to commercially available large precast panels.

U.S. Pat. No. 4,440,527 and U.S. Pat. No. 4,790,690 to Vidal, et al disclose wet environment and under water stabilized earth walls and the construction thereof. The earth walls include facing panels which have reinforcing members which are pivotally hingedly mounted thereon so that the reinforcing members can be lowered in a vertical plane onto the top of a lift of particulate material. Other related patents are: U.S. Pat. No. 1,762,343 to Munster; U.S. Pat. No. 4,929,125 to Hilfiker; and U.S. Pat. No. 3,686,873 to Vidal.

As is seen from the prior art, two types of facing walls have been developed for use with earth masses. The first type use earth reinforcements, such as geofabrics, geomats, geobars, and geogrids, all of which are flexible, to connect the wall to the earth mass and to stabilize the earth mass. The other type use rigid anchoring, such as tie-back anchors, as rigid reinforcement for the earth mass and to connect the earth mass to the facing wall. However, the stabilized earth masses tend to deform both during and after construction. Post construction deformations, as discussed in Pagano, et al. is caused by the compaction of granular fill material. Deformations during construction occur as the reinforcements for the earth mass are mobilized. The deformations are particularly experienced at the front face of the earth mass. A need exists for a simple and efficient retaining wall which can accommodate deformations in an earth wall both during and after construction to minimize lateral stresses imposed on the facing panels and resulting bulges in the planar surfaces of the facing panels. A further need exists for the capability of manually adjusting the panels after construction of the wall has been completed.

It is a purpose of the present invention to provide an retaining wall built from a number of facing panels wherein the facing panels are articulated and modular.

It is a further purpose of the present invention to provide such a wall including a number of horizontal joints between panels wherein the panels have a first degree of articulation by being capable of tilting in response to horizontal deformations in the earth mass.

It is a further purpose of the present invention to provide such a wall including a number of vertical joints between panels wherein the panels have a second degree of articulation by being capable of slipping and rotating relative to each other in response to non-uniform deformations in the earth mass which allows the facing panels to further accommodate shifts in the earth mass.

It is a further object of the present invention achieve the first degree of articulation by providing horizontally deformable, or flexible, anchoring between the facing panels and the earth mass to limit restraining anchoring forces.

It is a further object of the present invention to provide retaining wall wherein the panel alignment can be conveniently adjusted after the construction of the earth mass is complete.

DISCLOSURE OF THE INVENTION

In view of the foregoing background , an independent retaining wall for a mechanically stabilized earth mass is provided which is capable of deforming horizontally in response to horizontal deformations in the earth mass to reduce stresses applied to the retaining wall by the earth mass. The retaining wall is provided with a first tier of panels which includes at least a first facing panel. Each facing panel has an inner surface facing towards the earth mass, a front surface facing away from the earth mass, and first and second sides extending between the inner and front surfaces. Horizontally flexible anchoring means are provided which are connected to the inner surfaces of each of the panels for anchoring the panels to the earth mass to give the panels their capability to horizontally deform in response to horizontal deformations in the earth mass. It will be appreciated by those skilled in the art of facing walls that the horizontal deformability in the anchoring means provides effective articulation for the retaining wall to tilt to relieve more significant lateral earth pressures on the retaining wall.

In a preferred embodiment of the present invention, the horizontally flexible anchoring means includes a rigid anchor which has a first end extendable into the earth mass and an opposite second end connected to the inner surface of the panel via provided flexible connection means rigidly mounted to the inner surface of each facing panel. The flexible connection means flexibly connects the second end of the rigid anchor to the panel such that the panel is capable of moving horizontally relative to the rigid anchor in response to lateral pressures on the panel by the earth wall. The flexible connection means may be a generally C-shaped loop bar having generally curved upper and lower end portions extending from the panel inner surface towards the earth mass. The upper and lower portions are integrally interconnected by a flexible vertically oriented portion. The second end of the rigid anchor is provided with means for slidably engaging the rigid anchor to the flexible vertically oriented portion such that the anchor can vertically move in response to vertical stresses imposed upon it by the earth mass. It will be appreciated that the vertical adjustability of the anchor thus provided reduces the possibility of the anchor buckling from vertical shear stresses imposed upon it by the earth mass.

Independent mounting means may also be provided, mounted to the inner surface of each panel, to rigidly connect the flexible connection means to the panel's inner surface. The mounting means may be in the form of a flat plate with the curved end portions of the C-shaped loop bar integrally extending therefrom. It will be appreciated that the independent mounting means maintains the flexible anchoring means as an independent unit from the facing panel.

In the present invention, the first tier of the retaining wall is provided with at least a second facing panel. The first and second panels, and subsequent panel pairs, are interconnected by at least one pair of provided panel interconnectors mounted to the inner surfaces of the first and second panels. Each interconnector is provided with a central portion having a passage therethrough. First and second end portions are provided on opposite sides of the central portion. The first portion is connected to the inner surface of the first panel and the second portion is connected to the inner surface of the second panel. Thus, the first panel is adjacently interconnected to the second panel with the first side of the first panel spaced from the second side of the second panel by the central portion. The horizontally flexible anchoring means is connected to the panel interconnector by an end portion extending therethrough. Thereby, the flexible anchoring means is secured to the inner surfaces of both the first and second panels.

Front horizontal panel adjustment means are further provided to cooperate with the end portions of the flexible anchoring means and with panel interconnector. The horizontal adjustment means allow the tension of the connection between the horizontally flexible anchoring means and the panel interconnector to be varied from a point outwardly adjacent to the panel interconnector. The panels may thus be horizontally adjusted relative to the earth mass from the front side of the panels. It will be appreciated that the provision of the horizontal adjustment means allows for convenient horizontal alignment of the panels after the building of the earth wall behind the panels has been completed.

In another embodiment of the present invention, the horizontal flexible anchoring means includes a flexible anchor. The flexible anchor has a first end portion extendable into the earth mass and an opposite second end portion. A flexible portion integrally interconnects the first and second end portions. The second end portion extends through the passage in the central portion of a the panel interconnector to which it is connected into the space between the first and second side edges of the first and second panels. The horizontal adjustment means cooperates with the second end portion, as by a nut on a threaded second end portion to allow the tension of the connection between the anchor and the panel interconnector to be varied from the front side of the panels. The flexible anchor may be goose necked, having a generally U-shaped flexible portion.

In still another embodiment of the present invention, the flexible anchoring means includes a rigid anchor and a flexible connection means. The flexible connection means is rigidly mounted to each interconnector and may be a generally C-shaped bracket having generally parallel upper and lower horizontally oriented portions extending towards the earth mass. The upper and lower portions have first ends terminating in end portions and second ends being integrally interconnected by a flexible vertically oriented portion. Each of the end portions of the C-shaped bracket extends through the central portion passage of one of the panel interconnectors of the interconnector pair into the space between the first and second side edges of the first and second panels. Each of the horizontal adjustment means cooperate with the C-shaped brackets end portions, as by a nut on a threaded end portion, to allow the tension of the connection between the C-shaped bracket and the panel interconnector to be varied from the front side of the panels. Again, the second end of the rigid anchor is provided with means for slidably engaging the rigid anchor to the flexible vertical portion of the C-shaped bracket.

A pair of first brackets and a second pair of brackets are provided to allow minor slips and rotations at the joints between the panels. The first set of brackets are selectively rigidly mounted along an edge of the first panel defined by the first side and the inner surface of the first panel. The second set of brackets are selectively rigidly mounted to an edge of the second panel defined by the second side and the inner surface of the second panel. The first end portions of the interconnectors are pivotally mounted to the first set of brackets. The second end portions of the interconnectors are pivotally mounted to the second set of brackets. If more than two interconnectors are provided between each panel, a first and second bracket set is provided for each additional interconnector. It will be appreciated that the provision of these brackets allows the panels to better conform to non-uniform shifts in the earth mass.

An adjustable inner panel support is provided which may be used to anchor a pair of interconnected facing panels in the first tier of a retaining wall from behind the panels. The adjustable support is utilized before the construction of the earth wall and substitutes for the front bracing normally used in construction of retaining walls. The support includes an elongated vertical member. The member has a horizontal passage therethrough. Fastening means are provided for fastening the member to the panel interconnector. The fastening means has a first end portion capable of being laterally restrained by the member and a second end portion which extends through the passage in the vertical member and through the passage in the central portion of the interconnector into the space between the first and second sides of the panels. Horizontal adjustment means are provided which cooperate with the second end portion of the fastening means and the interconnector, as by a nut on a threaded second end portion, to allow the tension of the connection between the member and the panel interconnector to be varied from the front side of the panels. It will be appreciated that the adjustable internal panel support provides an effective substitute for front braces when property or right of use lines prevent the use of front braces.

In one embodiment of the inner panel support, the vertical member is capable of being driven into the existing foundation upon which the earth wall is to be built. In an alternate embodiment, the vertical portion is of a height greater than ⅔ of the panel height. A horizontal member also is provided which is longer than the vertical member. The horizontal member rigidly extends inwardly from the bottom of the vertical member, forming an L-shape with the vertical member. In this embodiment, the panel interconnector is rigidly mounted within the panels with the interconnectors first and second sides embedded into the first and second sides of the panels. This cantilevered embodiment may be used when it is not convenient to drive the vertical member into the foundation. The panel is supported by laying a layer of the earth wall down over the horizontal member. The earth wall layer may include a geofabric layer.

A method of constructing an adjustable independent retaining wall is also provided. The method includes the steps of providing a first tier of an adjustable independent retaining wall having at least a pair of first and second facing panels, at least a pair of panel interconnectors interconnecting the panels, horizontally flexible anchoring means connected to each of the panel interconnectors, and front horizontal panel adjustment means cooperating with the horizontally flexible anchoring means and with the panel interconnectors. The panels are erected to a generally vertical orientation on the foundation soil for the earth wall. The earth mass is back filled behind the interconnected panels to a height approximate to that of the lowermost panel interconnector. The interconnected panels are anchored to the earth mass with the lowermost flexible anchoring means. The earth mass is back filled behind the interconnected panels to a height approximate to that of the next lowermost panel interconnector. The interconnected panels are anchored to the earth mass with the next lowermost anchoring means. The interconnected panels are adjusted from their front with the horizontal adjustment means.

The method includes the further steps of providing a front adjustable inner panel support having an elongated vertical member, fastening means for fastening said vertical member to a panel interconnector, and front horizontal panel adjustment means cooperating with said fastening means. The inner panel support is connected to a panel interconnector. The vertical member may be driven into the foundation for the earth mass. If this is not feasible, a cantilevered inner panel support may be provided and its vertical member attached to the panel interconnector. A portion of the earth mass is laid down over the horizontal member to support the interconnected panels.

The method may further include the additional steps of providing a second tier of an adjustable independent retaining wall having at least a pair of first and second facing panels, at least a pair of panel interconnectors interconnecting the panels, horizontally flexible anchoring means connected to each of the panel interconnectors, and front horizontal panel adjustment means cooperating with the horizontally flexible anchoring means and with the panel interconnectors. The first tier of interconnected panels is battered towards the earth structure. Bridging is installed on the first tier for the placement of the second tier interconnected panels on the first tier. The second tier of interconnected panels is erected on the first tier. The second tier is anchored to the earth mass similarly to the first tier, except no inner panel supports are used on the second tier.

BEST MODE FOR CARRYING OUT THE INVENTION

Figure 1:
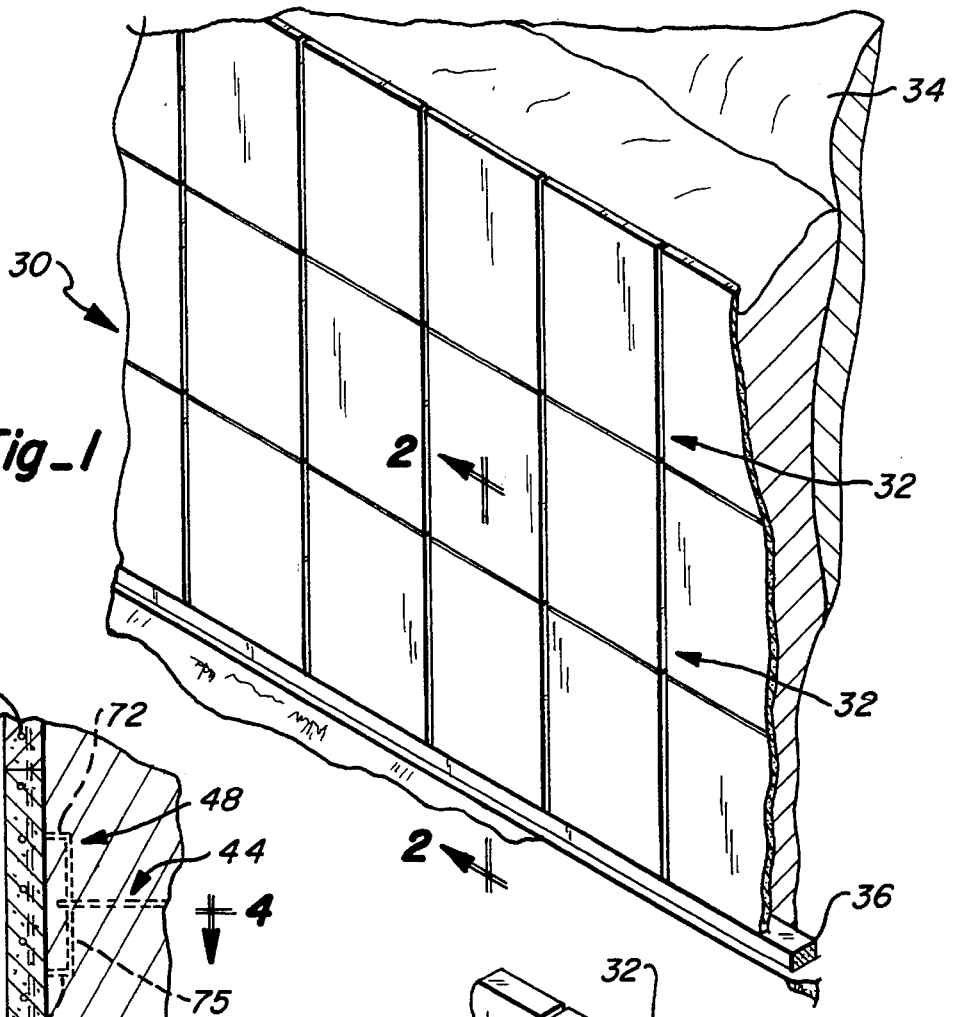
FIG. 1 is a fragmentary perspective view showing an independent retaining wall of facing panels of the present invention for a mechanically stabilized earth mass.

In accordance with the present invention, an independent retaining wall 30 is provided as shown in FIG. 1. In general, the retaining wall 30 is built from a number of facing panels 32 which provide a forming surface and permanent facing for a mechanically stabilized earth mass 34. The panels are intended to be used with various reinforcements for the earth mass 34 such as geofabric layers to contain back fill material and to anchor the reinforcements. The facing panels also provided protection against UV degradation of the geofabrics. Because the panels 32 are independent of the earth mass, the size and appearance of the retaining wall 30 can be tailored to the requirements of individual projects. A typical panel size is: H=10'; W=8'; T=0.5'. The panels 32 may be stacked in tiers up to three tiers to provide a wall as high as 30 feet. The assembly of the tiers proceeds together with the construction of the earth mass.

The panels 32, as will be described specifically herein, are anchored to the earth mass by flexible anchoring using either flexible anchors or using rigid anchors connected to the panels by flexible connections. The use of the flexible anchoring allows the panels to undergo minor tilts to relieve lateral earth pressures. The flexible anchoring of the present invention specifically permits the adjustment of panel alignment after the earth mass is completed, as will be described herein. Adjacent pairs of panels 32 are also flexibly interconnected so that they can undergo minor slips and rotations relative to each other at their vertical joints. The multiple tiers and the flexible anchoring provide a first degree of articulation to the wall at the horizontal joints between the adjacent tiers. The flexible interconnection between adjacent panels in a tier provide a second degree of articulation to the wall at the vertical joints. A third degree of articulation is provided by the flexible anchoring combinations.

Figure 2:
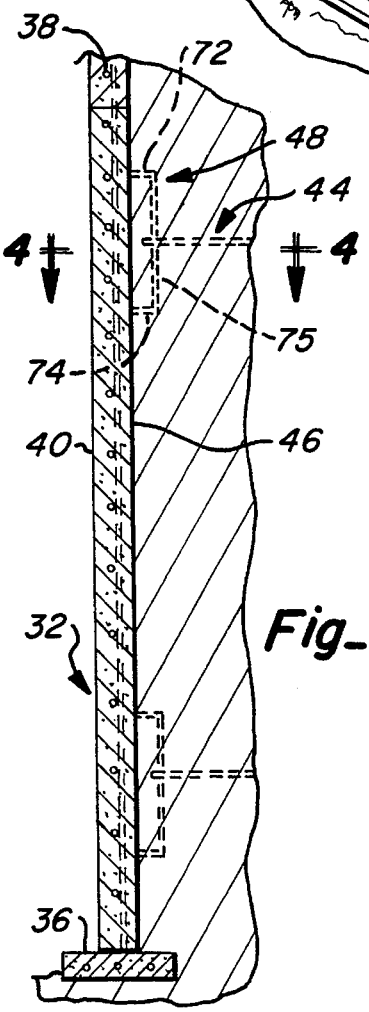
FIG. 2 is an enlarged vertical section, taken along the line 2—2 of FIG. 1, showing C-shaped brackets anchoring the panels to the earth mass.

An independent retaining wall 30 is shown in FIG. 1 having three tiers of panels 32 acting as a permanent facing for earth mass 34, with the first tier resting on footing 36. The footing must spread the dead load to the facing panels to the ground; weaker soils will require wider footing, stronger soils will allow more narrow footing. For most relevant applications, panels 32 may suitably consist of concrete reinforced with a single two-way mat of rebar 38. The panels have a front side 40 which faces away from the earth mass 34. Behind the panels 32, as shown in FIG. 2, rigid anchors 44 are connected to the inner surfaces 46 of the panels 32 via a C-shaped bracket 48. The rigid anchors 44 anchor the retaining wall 30 to the earth mass 34.

Figure 3:
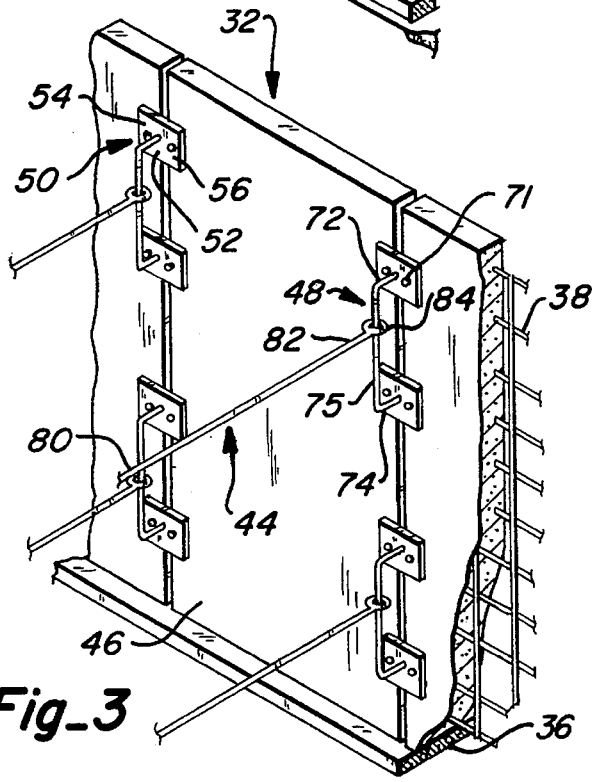
FIG. 3 is a fragmentary perspective view of the back of the retaining wall of FIG. 1 showing the panel interconnectors and the C-shaped brackets.

As seen in FIG. 3, wherein the earth mass 34 is not show for the purpose of clarity, adjacent pairs of panels 32 in the panel tier are interconnected by pairs of panel interconnectors 50. The interconnectors 50 may be made from steel and include a center section 52 and mounting areas 54, 56 on either side of the center section 52. Each mounting area 54, 56 is mounted to a respective adjacent panel 32 such that the two panels are interconnected with their adjacent sides 58, 60 spaced apart by the center section 52. At least two pairs of interconnectors 50 are used to interconnect the adjacent panels. The lowermost interconnector pair is mounted to the panels 32 at a median height approximately ¼ of the panels' height. The uppermost pair is mounted at median height approximately ¾ of the panels' height.

Figure 4:
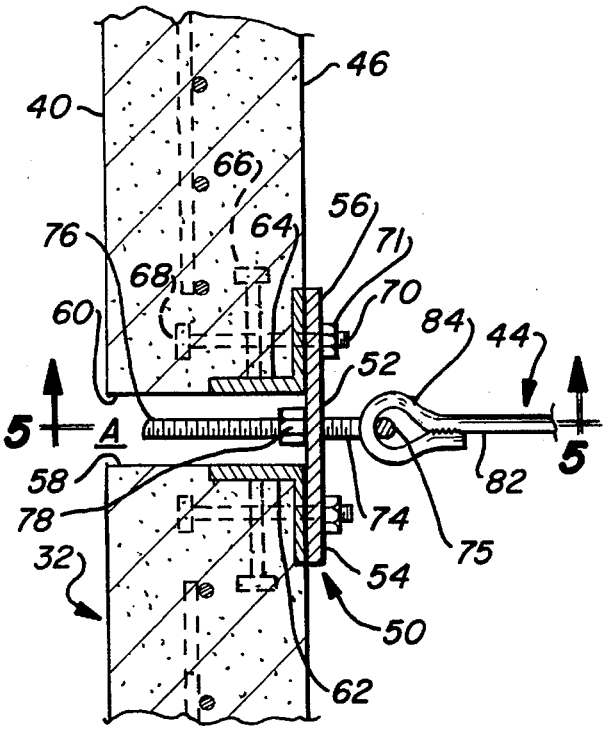
FIG. 4 is an enlarged horizontal section, taken along the line 4—4 in FIG. 2, showing the cooperation of the front adjustment nut, and the C-shaped bracket.

Looking at FIG. 4, each interconnector 50 is mounted to the adjacent interconnected panels 32 via a pair of provided angle brackets 62, 64. Each bracket 62, 64 in the pair is mounted to one of the panels to along an edge of the panel 32 defined by the inner surface 46 and the side 58 facing the side 60 of the adjacent interconnected panel 32 of the panel pair. The angle brackets 62, 64 may be made from steel, and are rigidly mounted to the panels 32 by steel studs 66, 68 embedded in the panels 32. Studs 68 have a threaded end 70 extending through a bore (not numbered) in each of the mounting areas 54, 56. Using nuts 71, mounting area 54 is semi-rigidly mounted to bracket 62 and mounting area 56 is semi-rigidly mounted to bracket 64. This semi-rigid mounting of the interconnector 50 to the angle brackets 62, 64 combined with interconnecting of adjacent panels 32 with the interconnector 50 64, allows the adjacent interconnected panels 32 to slip and rotate relative to each other to accommodate non-uniform stresses applied to the adjacent panel 32 by the earth mass.

Figure 5:
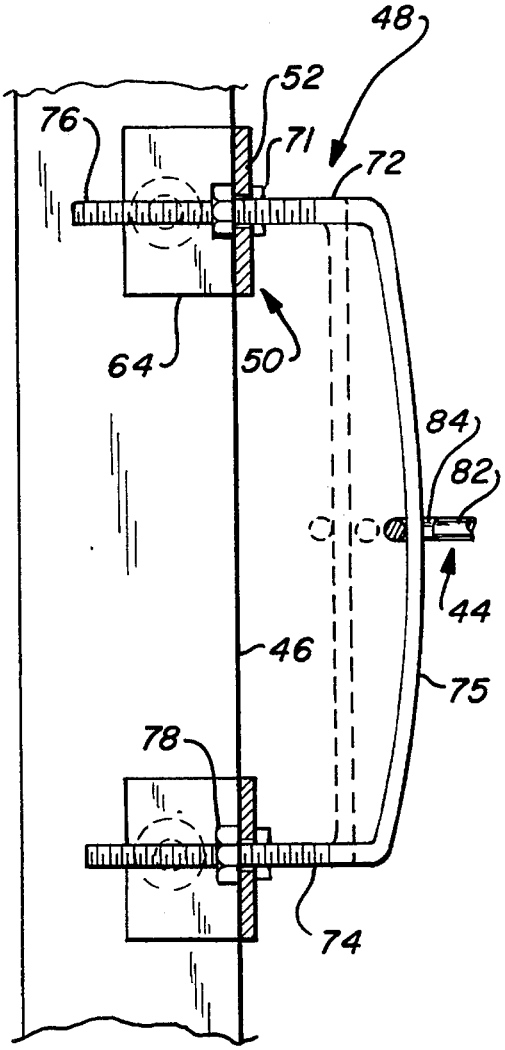
FIG. 5 is an enlarged vertical section, taken along line 5—5 of FIG. 4, showing the flexibility of the C-shaped bracket.

Returning to FIG. 3, the C-shaped bracket 48 is connected to each pair of panel interconnectors. The C-shaped bracket 48 has upper and lower horizontal sections 72, 74 integrally spaced by the vertical section 75. Each of the horizontal sections 72, 74 extend through an opening (not numbered) in a center section 52 of one of the panel interconnectors 50 the pair. As shown in FIGS. 4 & 5, the horizontal sections 72, 74 terminate in ends 76 located in the space A between the adjacent interconnected panels 32. The ends 76 are threaded and engaged by a front adjustment nut 78. The nut 78 can be variably tightened against the front side of the center section 52 of the interconnector 50 to urge the panels 32 inward towards the earth mass 34 or variably loosened to allow the earth mass to urge the panels 32 outward. Lateral stresses on the panels 32 applied by the earth mass may be reduced when the nut 78 is loosened to allow the panels 32 to be urged outward by the earth mass 34. Conveniently, the location of the adjustment nut 78 at the front of the interconnector 50 allows for the adjustment of the panel 32 to be accomplished after the earth mass has been completely built.

Each C-shaped bracket 48 is provided to flexibly connect one anchor 44 to the inner surfaces 46 of the adjacent facing panels. The anchors 44 have a first end 80 which extends into the earth mass 34. A second end 82 of the anchors 44 has a rigid loop 84 which is slidably engaged to the vertical section 75 of the C-shaped bracket 48. Both the anchor 44 and rigid loop 84 are formed from steel. As shown in FIG. 5, the vertical section 75 is capable of yielding, or flexing, when the anchor loads become too great from lateral stresses imposed on the panels 32 by the earth mass 34. The vertical section 75 thereby provides flexible anchoring of the panels 32 to the earth wall. The yield stress of the vertical section 75 is selectable for various design and load conditions. For example, for anchors with an 1800 lb. yield load, a vertical section 56 of ¾" diameter made from A36 steel stock may be used.

The slidable engagement of the anchor 44 onto the vertical section 75 allows for anchor to move vertically in response to vertical settling of the earth mass 34, in an amount proportional to the length of the vertical section 56. In a 12" C-bracket, the anchor 44 will have about 9" of vertical play. The yield of the vertical section 56 beneficially limits lateral stresses in the panels 32 created by shifts in the earth wall by allowing the wall 30 to tilt in response to lateral loads applied to it by the earth mass. The C-shaped bracket 48 thus accommodates both horizontal and vertical movements of the earth mass, permitting the use of the retaining wall 30 with compressible back fills.

Figure 12:
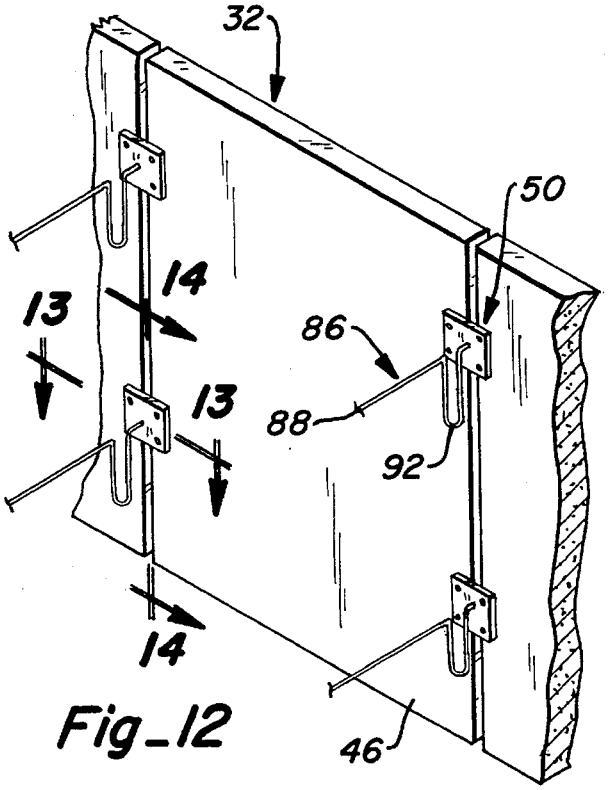
FIG. 12 is a fragmentary rear perspective view showing an independent retaining wall utilizing goose-necked anchors.
Figure 14:
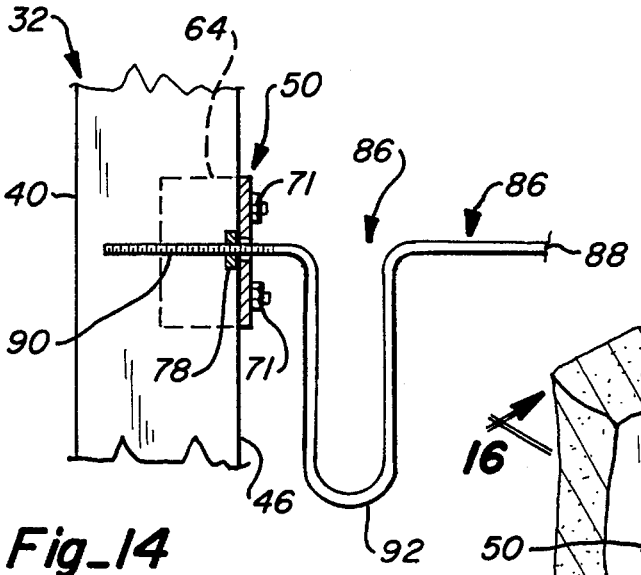
FIG. 14 is an enlarged vertical section, taken along the line 14—14 in FIG. 13, showing the U-shaped portion of the goose-necked anchor.

As shown in FIG. 12, a flexible anchor 86 may be connected to each panel interconnector 50 to provide flexible anchoring between the earth mass 34 and the interconnected facing panels. The flexible anchor 86 has an end section 88 which extends into the earth mass. A second end section 90 extends through the hole in the center area 52 of the panel interconnector 50 into the space A between the interconnected panels, as shown in FIG. 12. As best shown in FIG. 4, the flexible anchor 86 has a bent U-shaped section 92 between its two end sections. The second end 90 of the flexible anchor 86 is threaded and engaged by a nut 78 against the front of the interconnector 50 to allow front horizontal adjustment of the panel 32 in a manner similar to the C-shaped bracket 48. Similarly to the vertical portion 75 of the C-shaped bracket 48, the U-shaped section 92 is flexible in response to lateral loads to the interconnected panel pair to which the flexible anchor 86 is connected. The yield stress of the U-shaped portion is, again, selectable depending upon the needs of the project. The U-shaped, or gooseneck, anchor 86 may be used when vertical shifts in the earth mass are expected to be minimal thus reducing the need for vertical responsiveness of the anchor.

Figure 9:
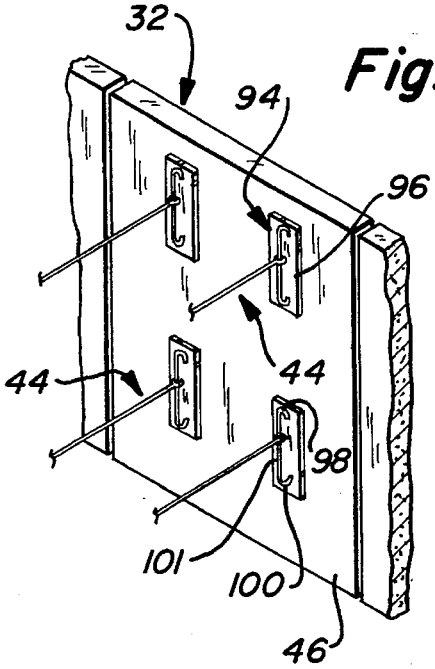
FIG. 9 is a fragmentary rear perspective view showing the C-shaped loop bars mounted to the inner surface of the facing panels.
Figure 10:
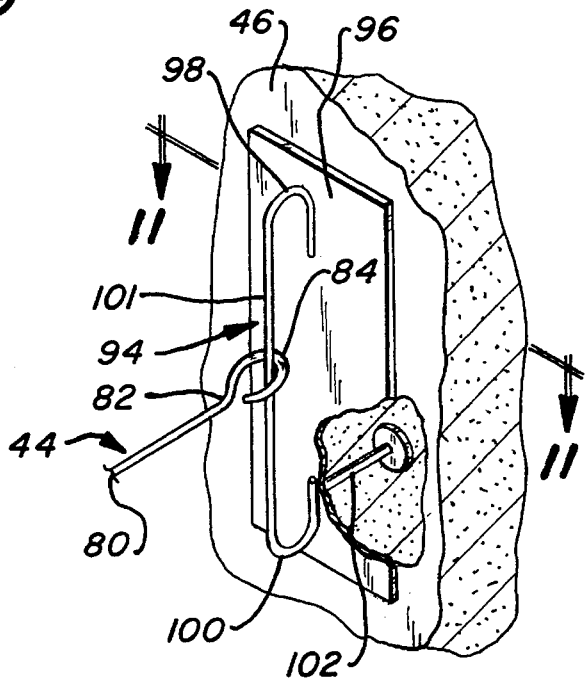
FIG. 10 is an enlarged fragmentary cut-away perspective view, showing the attachment of the mounting plate to the panel.
Figure 11:
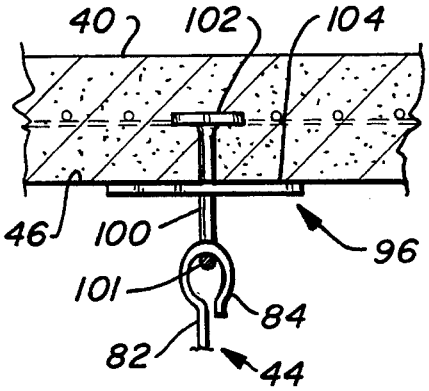
FIG. 11 is an enlarged horizontal section, taken along the line 11—11 in FIG. 10, showing the attachment of the mounting plate to the panel and the slidable engagement of the anchor to the loop bar.
Figure 13:
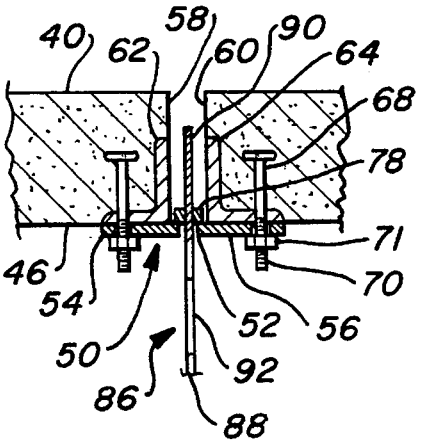
FIG. 13 is an enlarged horizontal section, taken along the line 13—13 of FIG. 12, showing the mounting of the angle brackets to the panels and the cooperation of the goose-necked anchor and the front adjustment nut.
Figure 15:
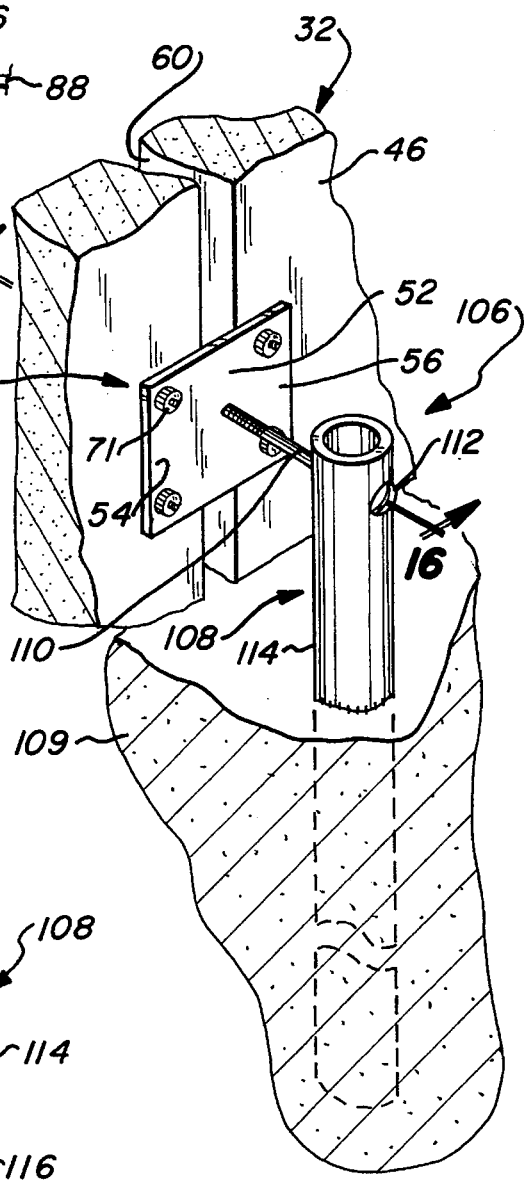
FIG. 15 is a fragmentary rear perspective view showing the inner panel support with a vertical member driven into the foundation of the earth mass.
Figure 16:
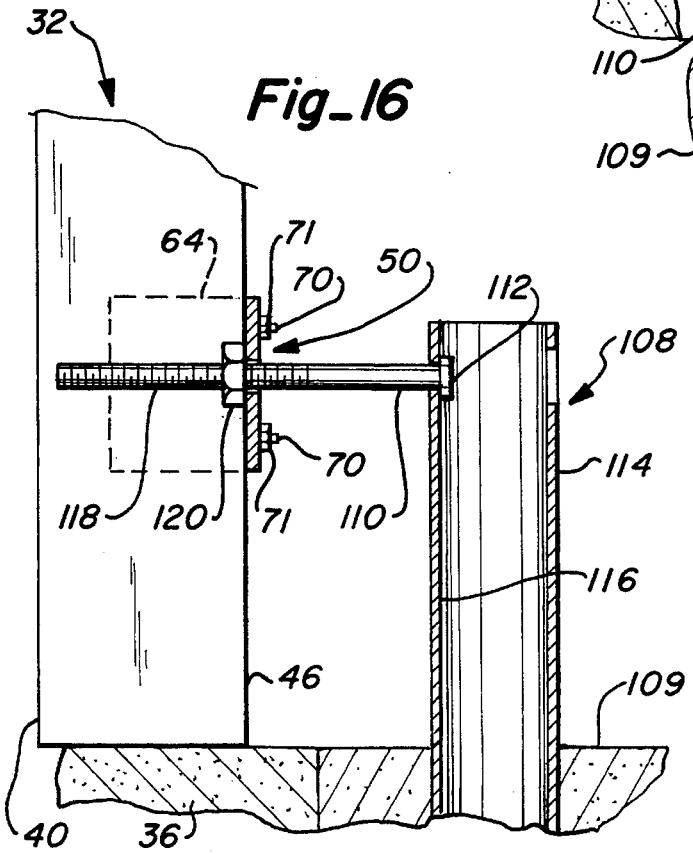
FIG. 16 is a horizontal section, taken along the line 16—16 in FIG. 15, showing the cooperation of the fastener and the panel adjustment nut.
Figure 17:
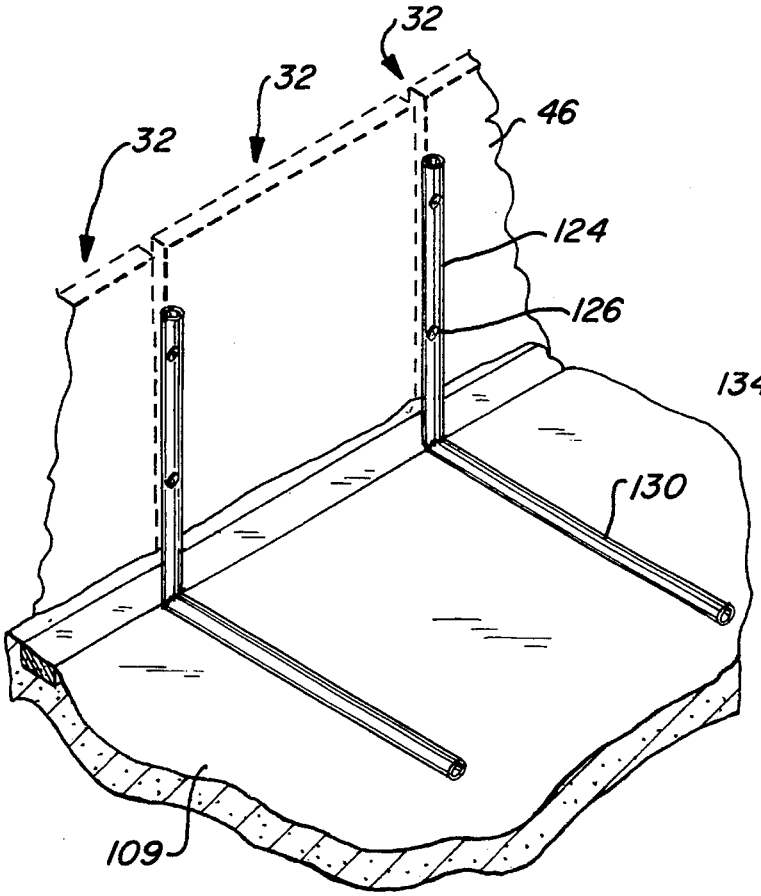
FIG. 17 is a fragmentary rear perspective view, showing the vertical and horizontal members of a cantilevered inner panel support.
Figure 20:
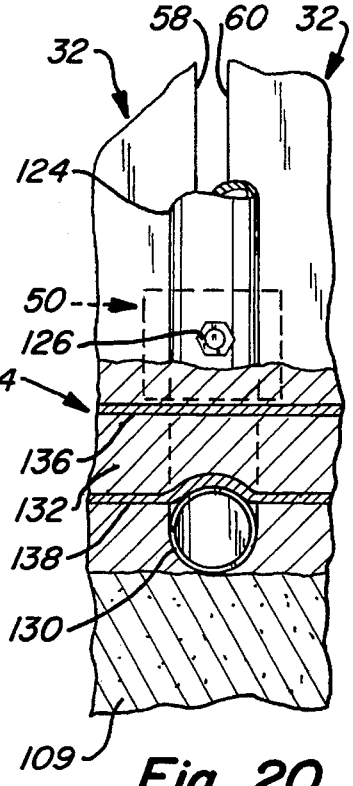
FIG. 20 is an enlarged vertical section, taken along the line 20—20 of FIG. 18, showing an earth mass layer and geofabric layers over the horizontal member of the cantilevered support.
Figure 18:
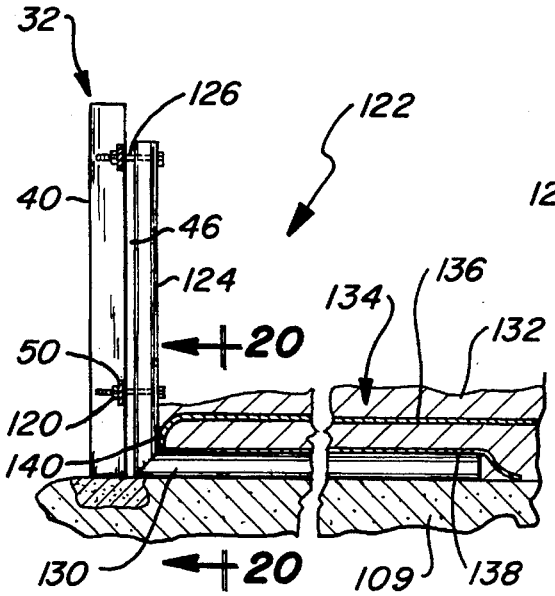
FIG. 18 is a fragmentary cross sectional view, showing a layer of the earth mass over the horizontal member.
Figure 19:
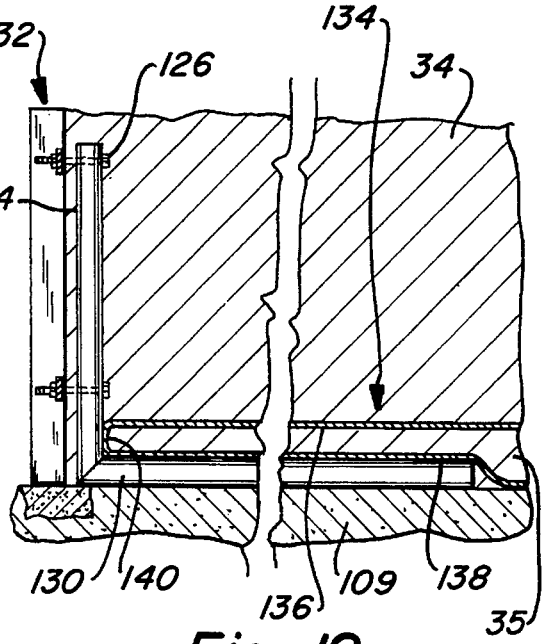
FIG. 19 is a fragmentary cross sectional view, showing an earth wall built up to the panel height.

As shown in FIG. 9, the retaining wall 30 may be provided with flexible anchoring similar to that provided with the C-shaped brackets 48, but having no front horizontal adjustability. The flexible anchoring is provided by a plurality of C-shaped loop bars 94 may be independently mounted to a single panel 32, rather than to interconnected panel pairs. This is a simpler design which can be utilized when front adjustability of the panels is either not feasible or not important. As best seen in FIG. 10, each C-shaped loop bar 94 is mounted to a mount plate 96. The C-shaped loop bar 94 is made from steel and is similar to the C-shaped bracket 48 except the C-shaped loop bar 94 has generally curved upper and lower sections 98, 100 which extend from the mount plate and which are integrally connected by a flexible vertical section 101. Again, a rigid anchor 44 with a rigid loop 84 is slidably engaged on the vertical section 101 so that the anchor 44 may move vertically along the vertical section. Each of the mount plates 96 are rigidly mounted to the inner surface of the panel by a stud 102 embedded into the panel 32 and integrally connected to the inner surface 104 of the mount plate 96.

Where right of use lines or property lines will not permit the use of front bracing in the construction of the retaining wall 30 to temporarily support the wall against wind and other horizontal impulse loads, an inner panel support 106, as shown in FIG. 15, may used to support the first tier of the wall 30 prior to the start of the earth mass construction and back filling operations. One version of the inner support 106 consists of a cylindrical pipe 108 of suitable metal, such as steel, which has a horizontal bore (not numbered) through it. The pipe 108 is capable of being driven into the foundation soil upon which the earth wall 34 is to be constructed, and is driven into the ground until the bore is approximately at the same height as the interconnector 50 via which the pipe 108 is to be connected to the inner surfaces of two interconnected panels. No other anchors are connected to the interconnector 50; the interconnector 50 is mounted to the panel 32 as before described in detail. A long threaded bolt 110 extends through the horizontal bore in the pipe, with the bolt head 112 restrained against either the outer surface 114, as shown in FIG. 15, or against the inner surface 116, as shown in FIG. 16, of the pipe. As shown, the end 118 of the bolt further extends through the bore in the center section of the interconnector 50. On the front side of the interconnector 50, a threaded restraining nut 120 engages the bolt end 118 to rigidly connect the pipe 108 to the interconnector 50. If desired, after the completion of at least the first tier of the earth mass, the restraining nut 120 may be removed and the bolt 110 disengaged from the interconnector 50, thereby disconnecting the pipe 108 from the wall 30.

As shown in FIGS. 17–20, in an alternate approach to supporting the first tier of the retaining wall 30 from the inner side of the wall, a cantilevered inner support 122 is secured to a pair of interconnected panels. The mounting sections 54, 56 of the interconnector 50 are embedded in the adjacent panels. The support includes a cylindrical pipe 124, approximately ⅔ the height of the panels, which has at least two horizontal bores (not numbered) through it. The pipe 124 is vertically connected to the panels 32 by bolts 126, each of which extends through a bore in the pipe and the interconnector 50 to engage with a restraining nut 128. A horizontal pipe 130 extends from the bottom of vertical pipe 124 at approximately a right angle, forming an L-shaped profile with the vertical pipe 124. The horizontal pipe 130 is longer than the vertical pipe 130, for stability. Conveniently, a layer of the earth mass 132 is laid over the horizontal pipe 130 to support the panels 32. This layer may include a geofabric layer 134 earth reinforcement. It will be appreciated that, once the earth mass layer 132 and geofabric layer 134 is applied over the horizontal pipe 130, the panels 32 are sufficiently supported to proceed with the remaining construction of the earth mass. This approach may be used where flexible anchoring of the wall is not necessary or is not of primary importance.

Figure 7:
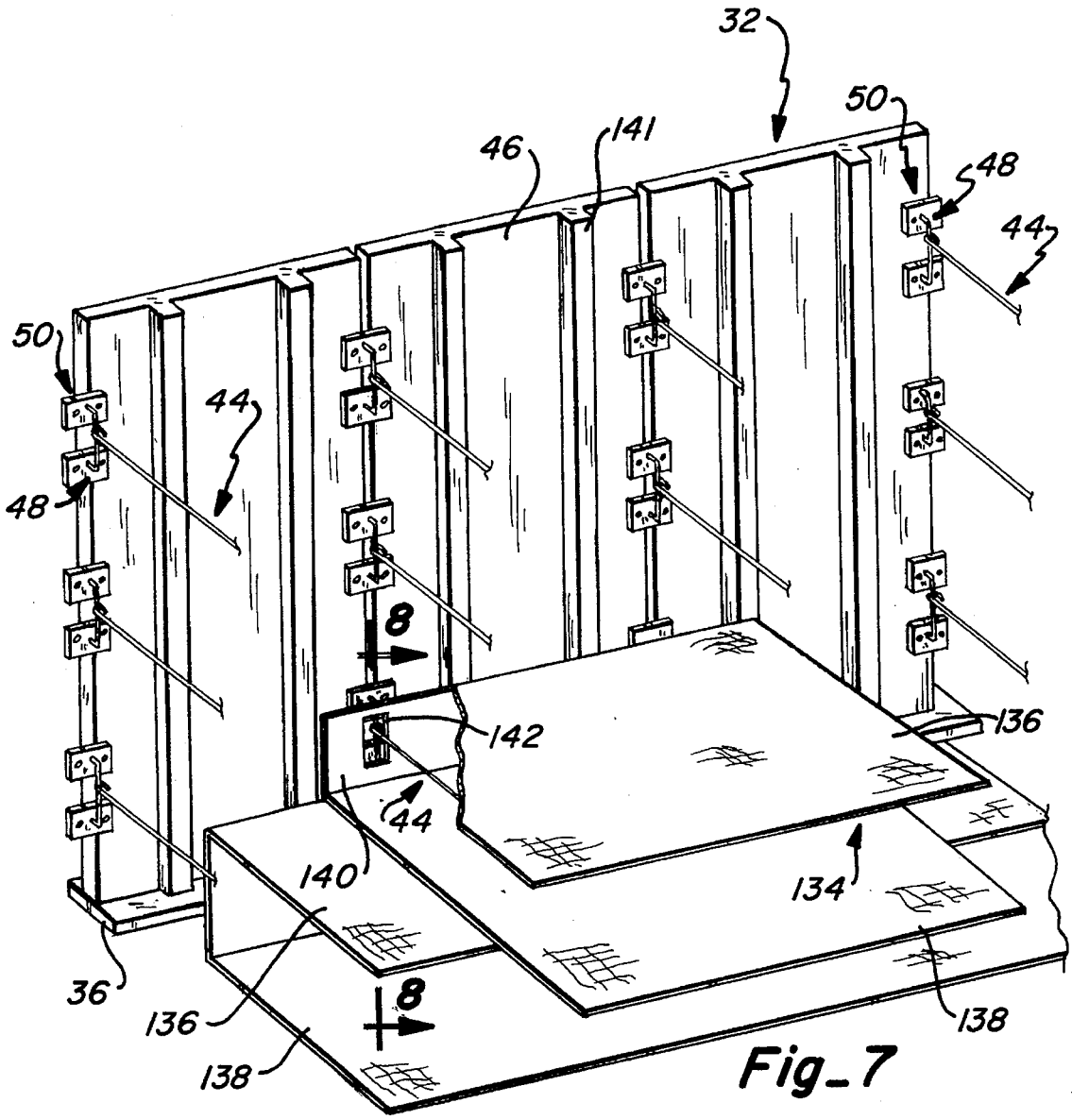
FIG. 7 is a rear perspective view of showing a webbed independent retaining wall utilizing geofabric layers.
Figure 8:
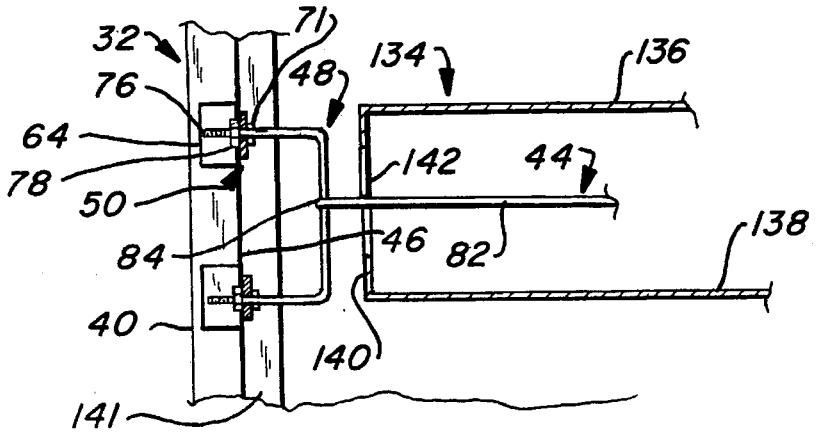
FIG. 8 is an enlarged vertical section, taken along the line 8—8 of FIG. 7, showing the anchor extending through a slotted vertical portion of a geofabric layer.

As best shown in FIG. 7, geofabric layers 134, or equivalent earth mass reinforcements which can be constructed with a wrapped front, are used in a manner familiar to the art to stabilize the earth mass 34. The retaining wall is used as an independent structural feature of the earth mass 34. This use of the retaining wall 30 yields a design solution to the boundary problem at the front of the earth mass wherein reinforcement may not be effective. As shown in FIGS. 7 & 8, each geofabric layer 134 has upper and lower portions 136, 138 which extend into the earth mass 34. These portions are spaced by a layer 35 of the earth mass 34 adjacent to a vertical portion 140 which interconnects the two portions. The geofabric layers 134 are generally not connected to the wall 30, though such a connection would beneficially anchor the layers 134 to the wall. Such a connection between the layers 134 and the wall 30 would impair the tiltability of the wall and reduce the effectiveness of the flexible anchoring provided between the wall 30 and the earth mass 34. Therefore, where necessary, a slot 142 may be provided in the vertical portion 140 of the geofabric layer. The slot is of a length sufficient to not interfere with the vertical movement of the anchor 44 which may extend through the slot 142 into the earth mass 34. The vertical portion 140, thus, is located inwardly adjacent to the C-bracket 48 in a non-interfering relationship with it.

Figure 6:
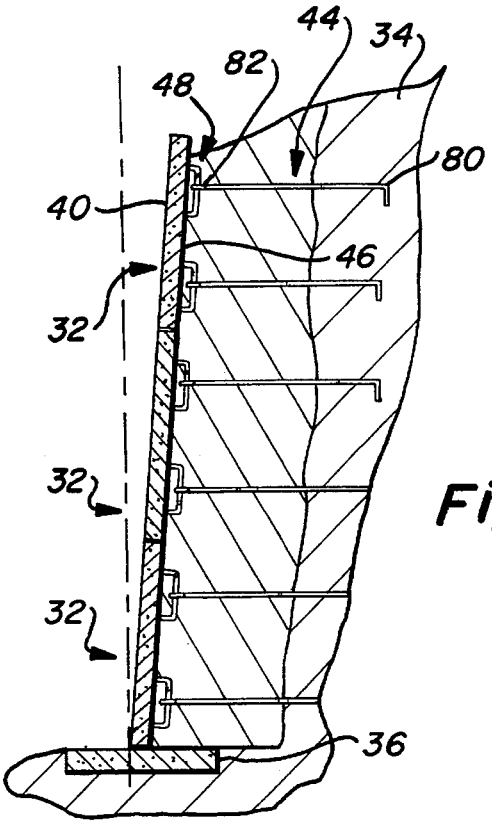
FIG. 6 is a cross sectional view of the independent retaining wall showing the retaining wall battered towards the earth mass.

From the foregoing description, it will be apparent that an adjustable independent retaining wall for a mechanically stabilized earth mass may be constructed which is more capable of conforming to shifts in the earth mass to reduce stresses felt by the wall. A first tier is built by interconnecting panel pairs with the interconnector pairs and attaching to the interconnectors 50 one of the horizontal flexible anchoring types as described before. The interconnected panel pairs are placed in a vertical position on the foundation soil and temporarily braced, either by traditional front bracing or with the inner panel support. As shown in FIG. 6, the tier may also be battered towards the earth mass. 2 to 3 inches of batter per 10 feet of wall height is typical. The earth mass is back filled behind the interconnected panels to a height approximate to that of the lowermost panel interconnector. Geofabric layers may be emplaced into the earth mass and connected to the wall via the interconnectors. The lowermost anchors are also emplaced into the back fill. More of the earth mass is back filled behind the panels to the height of the next row of anchors and that row of anchors and geofabric layers are emplaced into the earth mass. The built-up of the earth mass proceeds until it has reached the height of the first tier. The panels may be adjusted from the front of the panels with the front adjustment nuts. If subsequent tiers are desired, bridging may be installed between the first and second, or subsequent, tiers. The earth mass may be built, and the second tier anchored thereto, in the same manner as the first tier.

From the foregoing description, a number of significant advantages of the present invention should be readily apparent. A retaining wall is provided having independent, modular facing panels which are articulated. Horizontally flexible anchoring between the panels and the earth wall allows the panels to tilt about their base to accommodate horizontal deformations in the earth mass. Means for horizontally adjusting the panels from the front of the panels are provided so that individual panel alignment can be manually adjusted after the completion of the earth wall to accommodate non-uniform stresses over entire wall. Panel interconnectors 50 are provided and mounted to the panels such that adjacent interconnected panels in a tier are capable of slipping and rotating relative to each other providing a second degree of articulation at the vertical joints between the adjacently interconnected panels. Geofabric layers are easily secured to the facing panels to anchor the layers to the wall and increase the effectiveness of the layers. Inner panel support means are provided to substitute for traditional front bracing where it is undesirable or not possible to use such front bracing. A method is disclosed wherein modular facing panels capable of flexing in response to horizontal earth mass load are can be erected and their panel alignment adjusted after the earth mass has been completely built.

This invention has been described in detail with reference to particular embodiments thereof, but it will be understood that various other modifications can be effected within the spirit and scope of this invention.

We claim:

1. An adjustable independent retaining wall of horizontally front adjustable facing panels for a mechanically stabilized earth mass, said facing panels capable of deforming horizontally in response to horizontal deformations in the earth mass, said retaining wall comprising:

a first tier of panels having at least a pair of first and second facing panels, each said facing panel having an inner surface facing towards the earth mass, a front surface facing away from the earth mass, and first and second sides extending between said inner and front surfaces;

at least a pair of panel interconnectors mounted to said inner surfaces of said first and second panels, each said interconnector having a central portion with a passage therethrough, and first and second end portions on opposite sides of said central portion, said first portion connected to said inner surface of said first panel, said second portion connected to said inner surface of said second panel, such that said first panel is adjacently interconnected to said second panel with said first side of said first panel spaced from said second side of said second panel by said central portion;

horizontally flexible anchoring means connected to each said panel interconnector for anchoring said first and second panels to said earth mass such that said panels are capable of horizontally deforming in response to horizontal deformations in the earth wall thereby reducing lateral stress imposed on the panel by the earth mass, said anchoring means having an end portion extending through said passage in said interconnector; and front horizontal panel adjustment means cooperating with said end portion of said horizontally flexible anchoring means and with said panel interconnector for horizontally adjusting said interconnected panels, said front horizontal adjustment means allowing the tension of the connection between said flexible anchoring means and said panel interconnector to be varied from a point outwardly adjacent to said panel interconnector thereby allowing said panels to be horizontally adjusted from the front side of said panels.

2. An adjustable independent retaining wall, as claimed in claim 1, wherein said horizontally flexible anchoring means comprises:

a flexible anchor having a first end portion extendable into the earth mass, an opposite second end portion extending through said passage in said central portion of a said panel interconnector into the space between said first and second sides of said first and second panels, and a flexible portion integrally interconnecting said first and second end portions, said flexible portion having a selected yield stress such that it is capable of horizontally flexing responsive to lateral stresses applied to said panel by the earth mass in excess of said yield stress.

3. An adjustable independent retaining wall, as claimed in claim 2, wherein:

said second end portion of said flexible anchor is threaded; and said front horizontal adjustment means is threadably rotatably mounted on said second end portion of said flexible anchor.

4. An adjustable independent retaining wall, as claimed in claim 2, wherein:

said flexible anchor is a goose-neck anchor, said flexible portion being generally U-shaped.

5. An adjustable independent retaining wall, as claimed in claim 1 wherein said horizontally flexible anchoring means comprises:

a rigid anchor having a first end extendable into the earth mass and an opposite second end; and flexible connection means, rigidly mounted to each said panel interconnector, for flexibly connecting said second end of said rigid anchor to said panels.

6. An adjustable independent retaining wall, as claimed in claim 5, wherein:

said flexible connection means is comprised of a generally C-shaped bracket having generally parallel upper and lower horizontally oriented portions extending towards the earth mass, said upper and lower portions having first ends terminating in end portions and second ends being integrally interconnected by a flexible vertically oriented portion, each of said end portions of said C-shaped bracket extending through a said passage in a said central portion of one of said panel interconnectors of said interconnector pair into the space between said first and second side edges of said first and second panels; and said second end of said rigid anchor includes means for slidably engaging said second end of said rigid anchor on said flexible vertical portion of said C-shaped bracket such that said anchor is capable of moving vertically responsive to vertical stresses imposed upon said anchor by the earth mass.

7. An adjustable independent retaining wall, as claimed in claim 6, wherein:

said end portions of said C-shaped bracket are threaded; and said front horizontal adjustment means is threadably rotatably mounted on each said end portions of said C-shaped bracket.

8. An adjustable independent retaining wall, as claimed in claim 1, further comprising:

at least a pair of first brackets selectively rigidly mounted along an edge of said first panel defined by the first side and said inner surface of said first panel; and at least a pair of second brackets selectively rigidly mounted to an edge of said second panel defined by said second side and said inner surface of said second panel, said first end portion of each of said interconnectors being pivotally connected to a said first bracket, and each said second end portion of said interconnector being pivotally connected to a said second angle bracket.

9. An adjustable independent retaining wall, as claimed in claim 1, further comprising:

at least one geofabric layer having first and second generally parallel horizontally oriented portions extending into the earth mass, said horizontally oriented portions integrally connected and spaced by a vertical portion extending therebetween, wherein said vertical portion has a slot therein, the length of said slot being approximately equal to the length of said vertical portion of said C-shaped bracket, and wherein said first end of said rigid anchor extends therethrough.

10. A front adjustable inner panel support for supporting a pair of adjacently interconnected first and second facing panels to a foundation for an earth mass from the inner side of said panels, said inner panel support comprising:

an elongated vertical member having a least one horizontal passage therethrough;

a panel interconnector having a central portion with a passage therethrough, and first and second end portions on opposite sides of said central portion, said first portion connected to said first panel, said second portion connected to said second panel such that said first panel is spaced from said second panel by said central portion;

fastening means for fastening said vertical member to said interconnector, each said fastening means having a first end portion capable of being laterally restrained by said member and a second end portion extendable through said passage in member and also extendable through said passage in said interconnector central portion into the space between said panels; and front horizontal panel adjustment means cooperating with said second end portion of each said fastening means and with said panel interconnector for horizontally adjusting said interconnected panels, said front horizontal adjustment means allowing the tension of the connection between said fastening means and said panel interconnector to be varied from a point outwardly adjacent to said panel interconnector thereby allowing said panels to be horizontally adjusted from the front side of said panels.

11. A front adjustable inner panel support, as claimed in claim 10, wherein:

said vertical member is capable of being driven into the foundation for the earth mass.

12. A front adjustable inner panel support, as claimed in claim 10, wherein:

said second end portions of each said fastening means are threaded; and said front horizontal adjustment means is threadably rotatably mounted on each said second end portions of horizontal adjustment means.

13. A front adjustable inner panel support, as claimed in claim 10, wherein said vertical member is of a height at least ⅔ of the height of said panels, said inner support further comprising:

a horizontal member, of a length greater than said vertical member, rigidly extending inwardly from the bottom of said vertical member.

14. A method of constructing an adjustable independent retaining wall for a mechanically stabilized earth mass comprising the steps of:

providing a first tier of an adjustable independent retaining wall having at least a pair of first and second facing panels, at least a pair of panel interconnectors interconnecting the panels, horizontally flexible anchoring means connected to each of the panel interconnectors, and front horizontal panel adjustment .means cooperating with the horizontally flexible anchoring means and with the panel interconnectors;

a) erecting the interconnected panels in a generally vertical orientation on the foundation soil for the earth wall;

b) back filling an earth mass behind the interconnected panels to a height approximate to that of the lowermost panel interconnector;

c) anchoring the interconnected panels to the earth mass with the lowermost flexible anchoring means;

d) back filling the earth mass behind the interconnected panels to a height approximate to that of the next lowermost panel interconnector;

e) anchoring the interconnected panels to the earth mass with the next lowermost anchoring means; and f) adjusting the interconnected panels from the front side of the panels with the front horizontal adjustment means.

15. A method of constructing an adjustable independent retaining wall as claimed in claim 14, comprising the further steps of:

providing a front adjustable inner panel support having an elongated vertical member, fastening means for fastening said vertical member to a panel interconnector, and front horizontal panel adjustment means cooperating with said fastening means; and fastening an inner panel support to the inner surface of a panel in a panel interconnector.

16. A method of constructing an adjustable independent retaining wall, as claimed in claim 15, wherein the inner panel support has a generally cylindrical vertical member capable of being driven into the foundation for the earth mass, comprising the further step of:

driving the vertical member of the inner panel support into the foundation for the earth mass.

17. A method of constructing an adjustable independent retaining wall, as claimed in claim 15, wherein the inner panel support has a vertical member of a height at least ⅔ of the height of the panels and a horizontal member longer than the vertical member and rigidly extends inwardly from the bottom of the vertical member, comprising the further step of:

laying a portion of the earth mass down over the horizontal member.

18. A method of constructing an adjustable independent retaining wall, as claimed in claim 14, comprising the further steps of:

providing a second tier of an adjustable independent retaining wall having at least a pair of first and second facing panels, at least a pair of panel interconnectors interconnecting the panels, horizontally flexible anchoring means connected to each of the panel interconnectors, and front horizontal panel adjustment means cooperating with the horizontally flexible anchoring means and with the panel interconnectors;

battering the first tier of interconnected panels towards the earth structure;

installing bridging for the placement of the second tier interconnected panels on the first tier;

erecting the second tier of interconnected panels on the first tier; and repeating steps (b)–(f) for the second tier of interconnected panels.

* * * * *